US009077063B2

(12) United States Patent
Chun et al.

(10) Patent No.: US 9,077,063 B2
(45) Date of Patent: Jul. 7, 2015

(54) WIDE-BAND MULTI-MODE FILTER

(75) Inventors: Dong-Wan Chun, Incheon (KR); Jae-Won Jang, Incheon (KR); Ki-Soo Shin, Incheon (KR)

(73) Assignee: Ace Technologies Corporation, Incheon-si (KR)

( * ) Notice: Subject to any disclaimer, the term of this patent is extended or adjusted under 35 U.S.C. 154(b) by 324 days.

(21) Appl. No.: 13/467,886

(22) Filed: May 9, 2012

(65) Prior Publication Data

US 2012/0293280 A1 Nov. 22, 2012

(30) Foreign Application Priority Data

May 19, 2011 (KR) ..... 10-2011-0047381

(51) Int. Cl.

| | |
|---|---|
| ***H01P 1/20*** | (2006.01) |
| ***H01P 7/10*** | (2006.01) |
| ***H01P 1/208*** | (2006.01) |
| ***H01P 1/201*** | (2006.01) |

(52) U.S. Cl.

CPC ..... *H01P 1/2086* (2013.01); *H01P 1/201* (2013.01); *H01P 7/105* (2013.01)

(58) Field of Classification Search

CPC ..... H01P 1/2056; H01P 7/10; H01P 7/06; H01P 1/201; H01P 7/105; H01P 1/2086

USPC ..... 333/202, 203, 219.1, 224, 227, 230, 333/231, 232, 233, 235, 17.1

See application file for complete search history.

(56) References Cited

U.S. PATENT DOCUMENTS

2011/0006856 A1* 1/2011 Kim et al. ..... 333/134

OTHER PUBLICATIONS

Merriam-webster Definition: www.marriam-webster.com/dictionary: Accessed on Mar. 28, 2014, Definition of "Plate".*

* cited by examiner

*Primary Examiner* — Benny Lee
*Assistant Examiner* — Jorge Salazar, Jr.
(74) *Attorney, Agent, or Firm* — TechLaw LLP

(57) ABSTRACT

A multi-mode filter for realizing wide-band is disclosed. The multi-mode filter includes a housing; a plurality of cavities formed in the housing; a plurality of resonators located in each of the cavities; at least one connector formed through a side wall of the housing; and at least one coupling element connected to the at least one connector in the cavities, the at least one coupling element coupling the at least one connector with at least one of the resonators respectively, wherein each of the at least one coupling element has "T" shape in view of front section and "L" shape in view of side section.

5 Claims, 7 Drawing Sheets

-PRIOR ART-

WIDE-BAND MULTI-MODE FILTER

TECHNICAL FIELD

Example embodiment of the present invention relates to a multi-band filter for generating sufficient coupling amount for multi-mode.

BACKGROUND ART

An RF cavity filter includes plural cavities formed therein to pass only a signal of frequency band in use, and is employed generally at a base station, etc. using comparative high power of a frequency signal.

The skirt characteristics and the insertion loss are important in view of the cavity filter. The skirt characteristics means a slope of a boundary band in a pass band characteristic curve and the insertion loss means loss at the input/output of the cavity filter.

The skirt characteristics is improved as the number of poles is increased, and the insertion loss is inversely proportional to the number of poles. In other words, the skirt characteristics has trade-off relation with the insertion loss, therefore the number of poles is determined by considering the skirt characteristics and insertion loss.

In general, the number of poles in cavity filter corresponds to the number of cavities, and the number of cavities is associated directly with size of the filter.

With the development of mobile communication, usage of the filter is being expanded, miniaturization and high-performance of the filter is required continually. A multi-mode filter is one of the filters developed according to the requirement.

The multi-mode filter uses multiple resonance modes in a single resonator unlike a single-mode filter. Therefore, the multi-mode filter is smaller in size compared to the single-mode filter, but has the advantage of high performance.

Meanwhile, conventional multi-mode filter uses port feeding. In other words, conventional multi-mode filter is fed by one of electric field coupling (E field coupling) and magnetic field coupling (H field coupling).

However, port feeding by electric field coupling without ground structure could not be applied to a cavity filter according to surge standard because the cavity filter according to surge standard must be grounded when port feeding is performed.

In addition, conventional multi-mode filter using port feeding by magnetic field coupling as shown in FIG. 1 could not obtain sufficient coupling amount to realize wide-band characteristic.

DISCLOSURE

Technical Problem

Example embodiment of the present invention provides a multi-band filter for generating sufficient coupling amount for multi-mode.

Technical Solution

A multi-mode filter according to one embodiment of the present invention includes a housing; a cavity formed in the housing; a resonator located in the cavity; at least one connector formed through a side wall of the housing; and at least one coupling element connected to the at least one connector in the cavity, the at least one coupling element coupling the at least one connector with the resonator, wherein the at least one coupling element is located between one of the at least one connector and the resonator, and the at least one coupling element is fixed at bottom part of the cavity, and wherein, each of the at least one coupling element has "T" shape when viewed from a front with respect to a viewing direction oriented from the resonator to one of the at least one connector, and has "L" shape when viewed from a side direction orthogonal to the viewing direction oriented from the resonator to one of the at least one connector.

A multi-mode filter according to another embodiment of the present invention includes a housing; a cavity formed in the housing; a resonator located in the cavity; at least one connector formed through a side wall of the housing; and at least one coupling element connected to the at least one connector in the cavity, the at least one coupling element coupling the at least one connector with the resonator, wherein the at least one coupling element is located between one of the at least one connector and the resonator, and the at least one coupling element is fixed at bottom part of the cavity, wherein each of the at least one coupling element has "T" shape when viewed from a front with respect to a viewing direction oriented from the resonator to one of the at least one connector, and has an "L" shape when viewed from a side direction orthogonal to the viewing direction oriented from the resonator to one of the at least one connector, and wherein, a horizontal part of the "T" shape is placed to face the resonator, a vertical part of the "T" shape is connected to a ground, and both E field coupling and H field coupling is generated between the at least one coupling element and the resonator.

Advantageous Effects

A multi-mode filter according to the present invention realizes wide-band characteristic.

BRIEF DESCRIPTION OF DRAWINGS

Example embodiments of the present invention will become more apparent by describing in detail example embodiments of the present invention with reference to the accompanying drawings, in which.

DETAILED DESCRIPTION

Hereinafter, embodiments of the present invention will be described in detail with reference to accompanying drawings.

Figure 1:
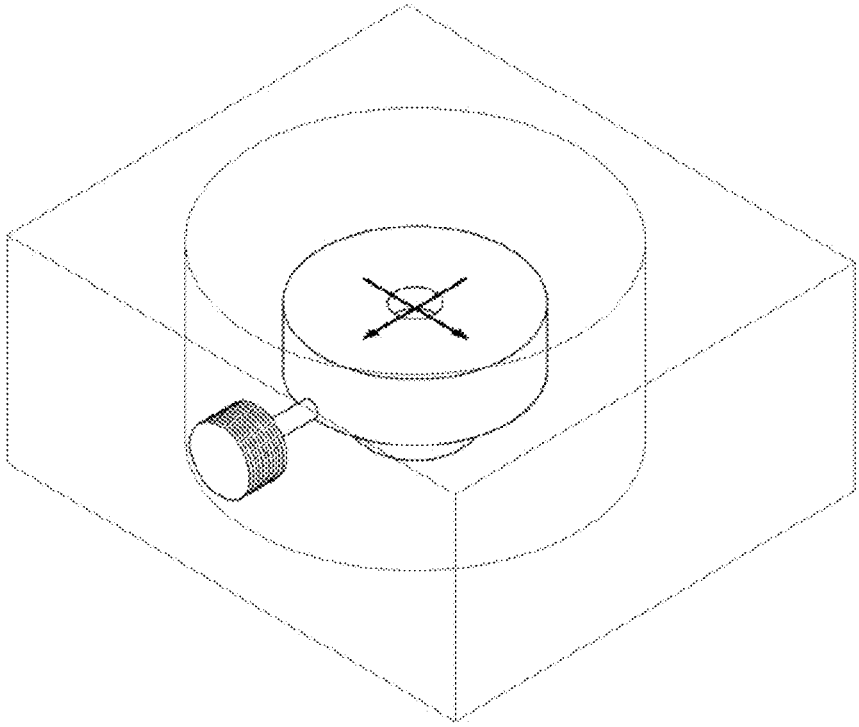
FIG. 1(Prior Art)
FIG. 1 is a perspective view of conventional multi-mode filter.
Figure 2:
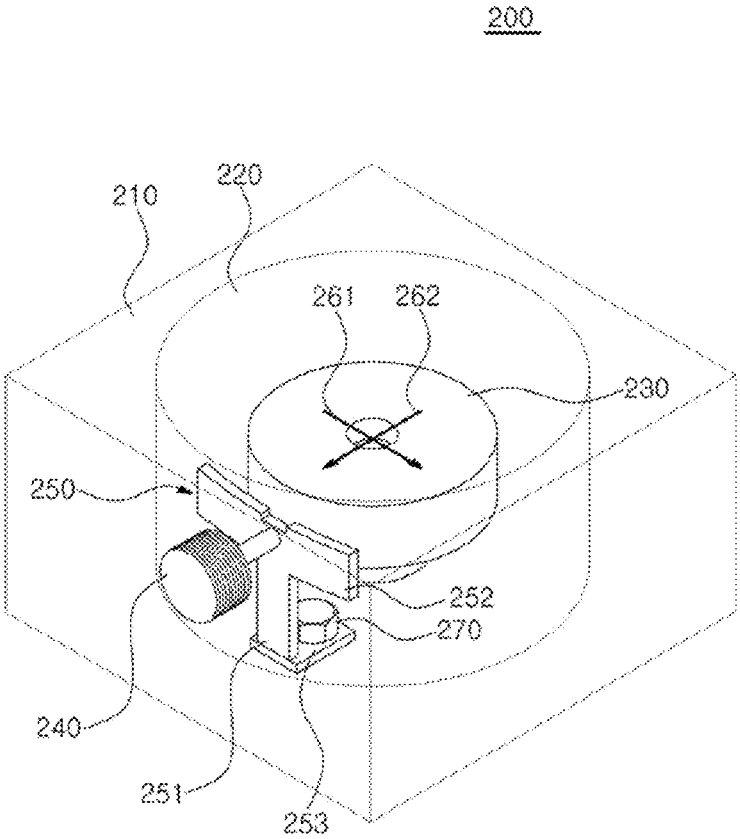
FIG. 2 is a perspective view illustrating a multi-mode filter according to a first embodiment of the present invention.
Figure 3:
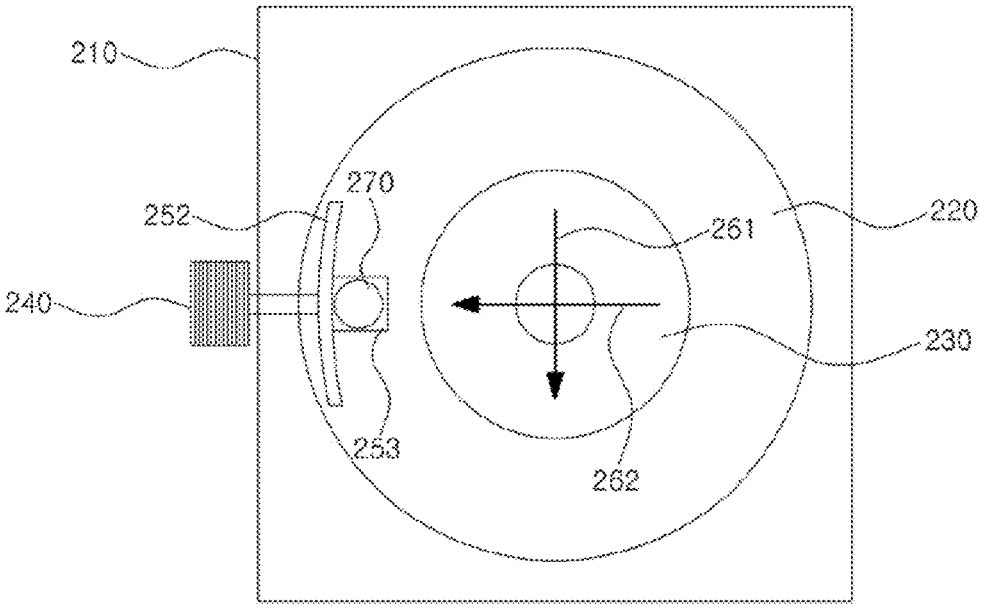
FIG. 3 is a plan view illustrating the multi-mode filter according to the first embodiment of the present invention.
Figure 4:
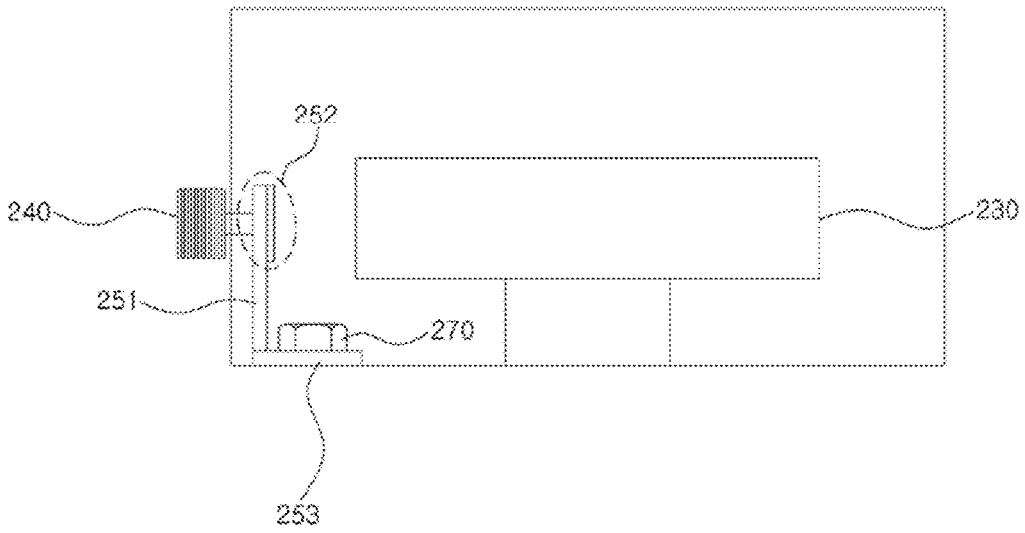
FIG. 4 is a side view illustrating the multi-mode filter according to the first embodiment of the present invention.

FIG. 2 is a perspective view illustrating a multi-mode filter according to a first embodiment of the present invention, FIG. 3 is a plan view illustrating the multi-mode filter according to the first embodiment of the present invention, and FIG. 4 is a side view illustrating the multi-mode filter according to the first embodiment of the present invention.

In FIGS. 2 to 4, the multi-mode filter according to the first embodiment of the present invention includes a housing 210, a cavity 220, a resonator 230, connector 240 and coupling element 250.

The housing 210 protects elements in the multi-mode filter, and blocks an electromagnetic wave. The housing 210 may be formed by coating silver having high conductivity on an aluminum material and operates as a ground The cavity 220 is space formed in the housing 210 for resonance. In FIGS. 2 and 3, the cavity 220 has cylindrical shape, but may have variously shapes as rectangular shape.

The resonator 230 is located in the cavity 220 for setting resonance frequency of each mode at multi-mode filter. The resonator 230 may be made up of a metal or dielectric member according to mode of the multi-mode filter, i.e. TE mode or TM mode.

In FIGS. 2 to 4, the resonator 230 has cylindrical shape, but may have variously shapes as rectangular shape or disk shape.

If the resonator 230 has cylindrical shape, a first mode 261 and a second mode 262 perpendicular to the first mode 261 may be generated in the cavity 220. In one embodiment, if height of the resonator 230 is relatively low (namely the resonator 230 has flat cylindrical shape), the first mode 261 and the second mode 262 may be HEH mode. In another embodiment, if height of the resonator 230 is relatively high, the first mode 261 and the second mode 262 may be HEE mode.

Meanwhile, the number of modes generated in the cavity 220 may be three and more.

The connector 240 is formed through a side wall of the housing 210. The connector 240 may be an input connector or an output connector.

The coupling element 250 is connected to the connector 240 in cavity 220, and performs coupling the connector 240 with the resonator 230. The coupling element 250 is made up of for example a metal, and has "T" shape in view of front section and "L" shape in view of side section.

In more detail, the coupling element 250 may include a first coupling plate 251, a second coupling plate 252 and a third coupling plate 253.

The first coupling plate 251 corresponds to a vertical part of the "T" shape and is placed in vertical direction in the cavity 220. The first coupling plate 251 generates H field coupling between the connect 240 and the resonator 230.

The second coupling plate 252 corresponds to a horizontal part of the "T" shape and is extended at an upper part of the first coupling plate 251, and is placed to face the resonator 230. In other words, the second coupling plate 252 is connected to the first coupling plate 251 and is placed to face the resonator 230. The second coupling plate 252 generates H field coupling between the connector 240 and the resonator 230.

The third coupling plate 253 is extended at a lower part of the first coupling plate 251, and placed to face a bottom of the housing 210.

The third coupling plate 253 connects the coupling element 250 with a ground stably. To this end, a hole with screw thread is formed on the third coupling plate 253, and the bottom of the housing 210 is combined with the third coupling plate 253 through a bolt 270. As a result, a lower part of the vertical part of the "T" shape is connected to the ground.

In brief, the multi-mode filter 200 according to one embodiment of the present invention generates both H field coupling and E field coupling, and obtains sufficient coupling amount between the connector 240 and the resonator 230. As a result, the multi-mode filter 200 can have wide-band characteristics.

Figure 5:
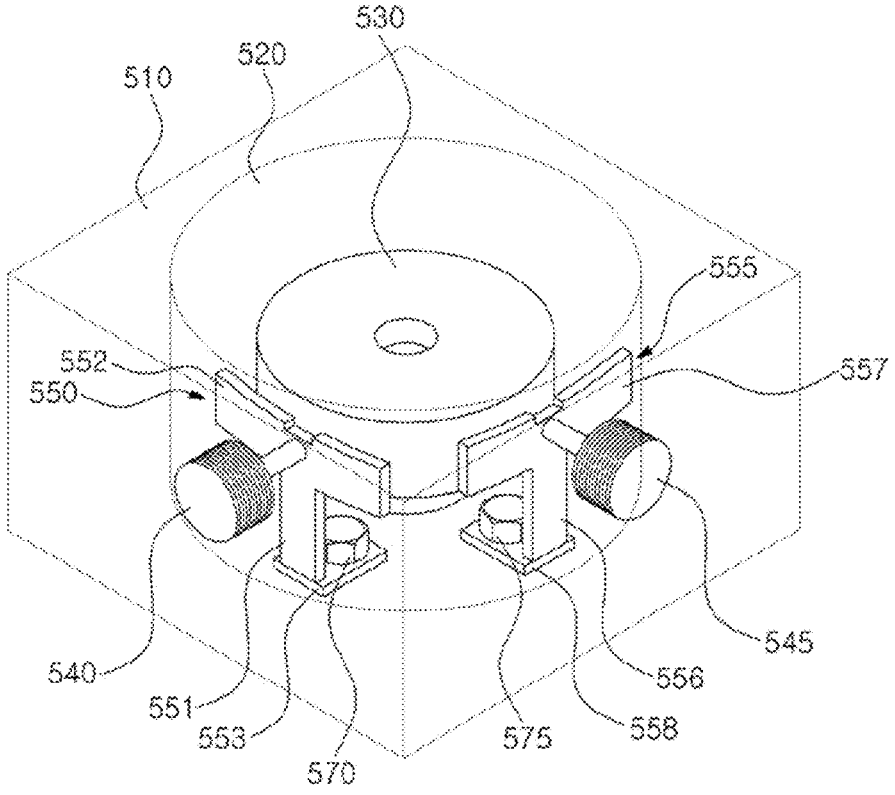
FIG. 5 is a perspective view illustrating a multi-mode filter according to a second embodiment of the present invention.

FIG. 5 is a perspective view illustrating a multi-mode filter according to a second embodiment of the present invention.

In FIG. 5, the multi-mode filter 500 according to the second embodiment of the present invention is the same in FIGS. 2 to 4 except that two connectors 540 and 545 are formed through the side wall of the housing 510, and the two connectors 540 and 545 are connected to each of two coupling element 550 and 555. In this case, one connector 540 may act as an input connector and another connector 545 may act as an output connector.

In addition, each of the two coupling element 550 and 555 perform coupling two connectors 540 and 545 with resonators 530 respectively using both H field coupling and E field coupling as explained in FIG. 2. In other words, multi-mode filter according to the present invention may be applied to a cavity filter with multiple connectors.

Comparison between the multi-mode filter 200 and 500 according to the present invention and conventional multi-mode filter is as follows.

A structure like the second coupling element 252, 552 and 557 do not exist in conventional multi-mode filter. Therefore, in the case of the conventional multi-mode filter, only H field coupling (namely, inductive coupling) is generated strongly and E field coupling (namely, capacitive coupling) is generated weakly or not generated.

However, as described above, in case of using the second coupling plates 252, 552 and 557, E field coupling is generated between the connectors 240, 540 and 545 and the resonators 230 and 530, accordingly coupling amount between the connectors 240, 540 and 545 and the resonators 220 and 520 is increased.

Therefore, according to the present invention, the coupling elements 250, 550 and 555 perform coupling the connectors 240, 540 and 545 with the resonators 230 and 530 using both E field coupling and H field coupling, thereby sufficient coupling amount is obtained, and multi-mode filter having wide-band characteristic can be implemented.

In another embodiment of the present invention, the input connector and the output connector may be connected to the coupling element 250, 550 and 555 in different cavity respectively. In this case, the connectors and the corresponding coupling elements are formed in corresponding cavities respectively.

Hereinafter, coupling simulation results about conventional multi-mode filter and multi-mode filter according to the present invention are explained.

Figure 6:
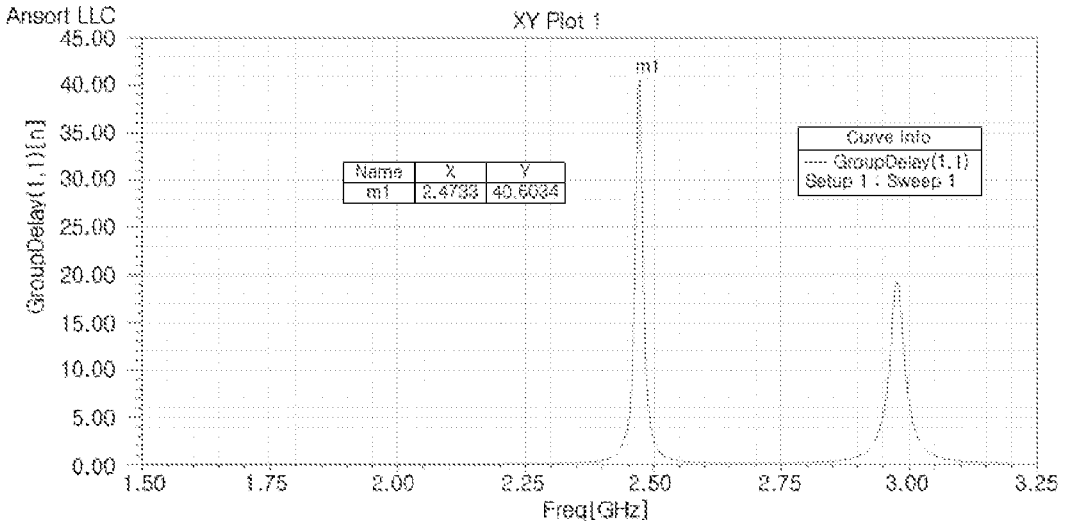
FIG. 6 is a view illustrating result graph of coupling simulation about conventional dual-mode filter.
Figure 7:
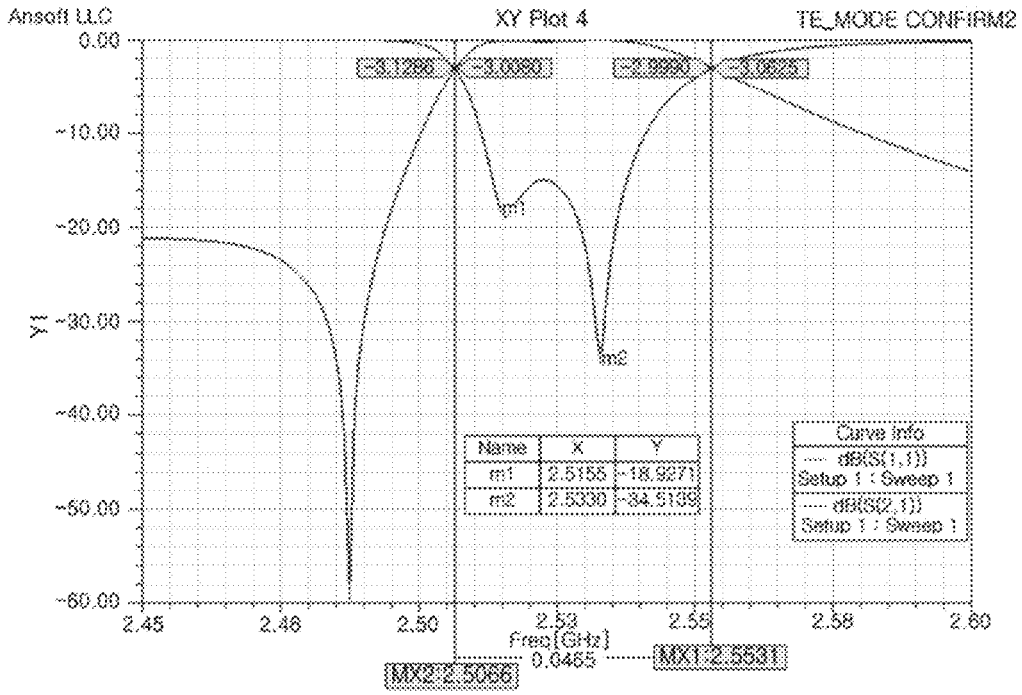
FIG. 7 is a view illustrating result graph of coupling simulation about a multi-mode filter according to a second embodiment of the present invention.

FIG. 6 is a view illustrating result graph of coupling simulation about conventional dual-mode filter, and FIG. 7 is a view illustrating result graph of coupling simulation about a multi-mode filter according to a second embodiment of the present invention.

To obtain characteristics of band pass filter with center frequency of 2.5 GHz and bandwidth of 30 MHz, group delay must be less than 18.15 ns. However, in case of using conventional dual-mode filter, group delay of 40 ns or less is difficult to obtain as shown in FIG. 6, therefore conventional dual-mode filter is difficult to obtain wide-band characteristic.

On the other hand, the multi-mode filter according to the second embodiment of the present invention has center frequency of 2.53 GHz and bandwidth of 46.5 MHz as shown in FIG. 7, therefore wider band pass characteristic can be obtained.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A multi-mode filter comprising:

a housing;

a cavity formed in the housing;

a resonator located in the cavity;

at least one connector formed through a side wall of the housing; and at least one coupling element connected to the at least one connector in the cavity, the at least one coupling element coupling the at least one connector with the resonator, wherein the at least one coupling element is located between one of the at least one connector and the resonator, and the at least one coupling element is fixed at a bottom part of the cavity, and wherein, each of the at least one coupling element is "T" shaped when viewed from a front with respect to a viewing direction oriented from the resonator to one of the at least one connector, and is "L" shaped when viewed from a side direction orthogonal to the viewing direction oriented from the resonator to one of the at least one connector.

2. The multi-mode filter of claim 1, wherein the at least one coupling element performs coupling the at least one connector with the resonator using both E field coupling and H field coupling.

3. The multi-mode filter of claim 1, wherein the at least one "T" and "L" shaped coupling element is defined by, a first coupling plate placed in a vertical direction when viewed from the front;

a second coupling plate extended at an upper part of the first coupling plate, the second coupling plate being placed to face the resonator;

a third coupling plate extended at a lower part of the first coupling plate, the third coupling plate being placed to face a bottom of the housing.

4. The multi-mode filter of claim 3, wherein the third coupling plate is connected to a ground.

5. A multi-mode filter comprising:

a housing;

a cavity formed in the housing;

a resonator located in the cavity;

at least one connector formed through a side wall of the housing; and at least one coupling element connected to the at least one connector in the cavity, the at least one coupling element coupling the at least one connector with the resonator, wherein the at least one coupling element is located between one of the at least one connector and the resonator, and the at least one coupling element is fixed at a bottom part of the cavity, wherein, each of the at least one coupling element is "T" shaped when viewed from a front with respect to a viewing direction oriented from the resonator to one of the at least one connector, and is "L" shaped when viewed from a side direction orthogonal to the viewing direction oriented from the resonator to one of the at least one connector, and wherein a horizontal part of the "T" shape is placed to face the resonator, a vertical part of the "T" shape is connected to a ground, and both E field coupling and H field coupling is generated between the at least one coupling element and the resonators.

* * * * *